US005685689A

United States Patent [19]

Schneider et al.

[11] Patent Number: 5,685,689

[45] Date of Patent: Nov. 11, 1997

[54] QUICK ATTACH SYSTEM FOR FRONT END LOADER

[75] Inventors: David E. Schneider, Great Bend; Harold Keith Garrison, Newton, both of Kans.

[73] Assignee: Great Bend Manufacturing Co., Inc., Great Bend, Kans.

[21] Appl. No.: 582,537

[22] Filed: Jan. 3, 1996

[51] Int. Cl.[6] ..... E02F 9/00

[52] U.S. Cl. ..... 414/723; 37/468

[58] Field of Search ..... 414/723; 37/468; 403/322, 324, 325

[56] References Cited

U.S. PATENT DOCUMENTS

| | | | |
|---|---|---|---|
| 2,963,183 | 12/1960 | Przybylski . | |
| 3,204,793 | 9/1965 | Lane . | |
| 3,220,487 | 11/1965 | Pilch . | |
| 3,231,117 | 1/1966 | Melroe et al. . | |
| 3,269,570 | 8/1966 | Wallberg . | |
| 3,672,521 | 6/1972 | Bauer et al. . | |
| 3,732,996 | 5/1973 | Bauer . | |
| 3,760,883 | 9/1973 | Birk . | |
| 3,794,195 | 2/1974 | Clevenger et al. . | |
| 3,818,551 | 6/1974 | Coughran, Jr. . | |
| 3,845,871 | 11/1974 | DiLillo et al. . | |
| 3,964,622 | 6/1976 | Blair et al. . | |
| 3,984,016 | 10/1976 | Kuhn . | |
| 3,985,249 | 10/1976 | Aker et al. . | |
| 4,030,624 | 6/1977 | Matthews . | |
| 4,106,645 | 8/1978 | Janish . | |
| 4,119,225 | 10/1978 | Macht et al. . | |
| 4,136,792 | 1/1979 | Wilson . | |
| 4,243,356 | 1/1981 | Takojima . | |
| 4,545,720 | 10/1985 | Cochran et al. . | |
| 4,586,867 | 5/1986 | Stafford . | |
| 4,812,103 | 3/1989 | Cochran et al. . | |
| 5,078,569 | 1/1992 | Cook . | |
| 5,098,252 | 3/1992 | Sheesley et al. | 414/723 |
| 5,263,810 | 11/1993 | Takekata et al. | 414/723 |
| 5,419,673 | 5/1995 | Merhar | 414/723 |

FOREIGN PATENT DOCUMENTS

| | | | |
|---|---|---|---|
| 0031659 | 3/1980 | Japan . | |
| 0065639 | 5/1980 | Japan . | |
| 57-137532 | 8/1982 | Japan | 37/468 X |
| 91351 | 3/1958 | Norway . | |
| 975029 | 11/1964 | United Kingdom . | |

*Primary Examiner*—Donald W. Underwood

*Attorney, Agent, or Firm*—Litman, McMahon and Brown, L.L.C.

[57] ABSTRACT

An improved quick attach system for removably attaching an implement, such as a bucket, to a front end loader includes a quick attach assembly connected to the lift arms and tilt operators of the front end loader. A pair of alignment members mate with alignment recesses on the bucket while a pair of spring-urged locking pins mate with a pair of brackets on the bucket. A common scissors-type pin retraction assembly is connected to the locking pins with a single release handle provided to move the pins between locked and release positions. The handle moves within a slot between as the pins move between the locked and release positions and a detent is provided for holding the handle, and the locking pins, in the release position. The handle is automatically urged from the detent position by a locking member on the loader as the bucket is attached to the loader, thus allowing the pins to lock into place in the bucket brackets.

5 Claims, 3 Drawing Sheets

Fig.5.
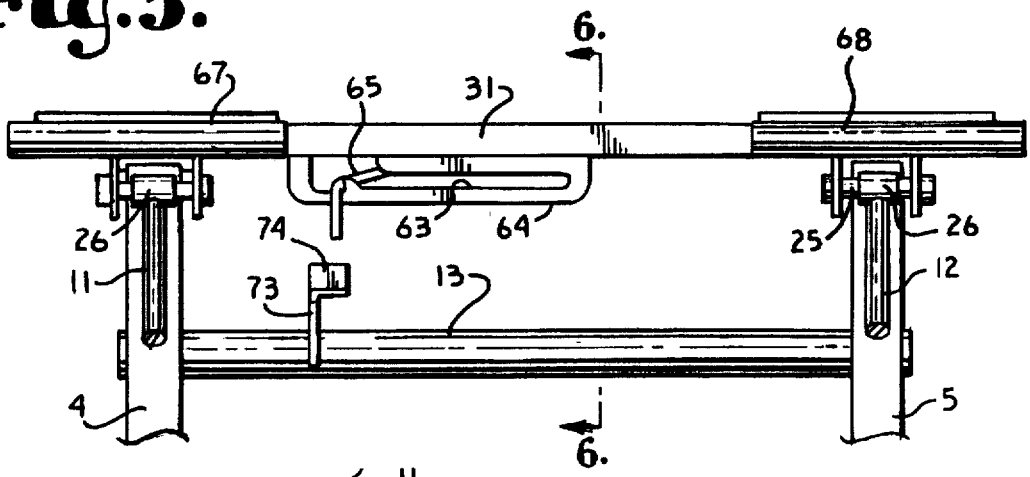
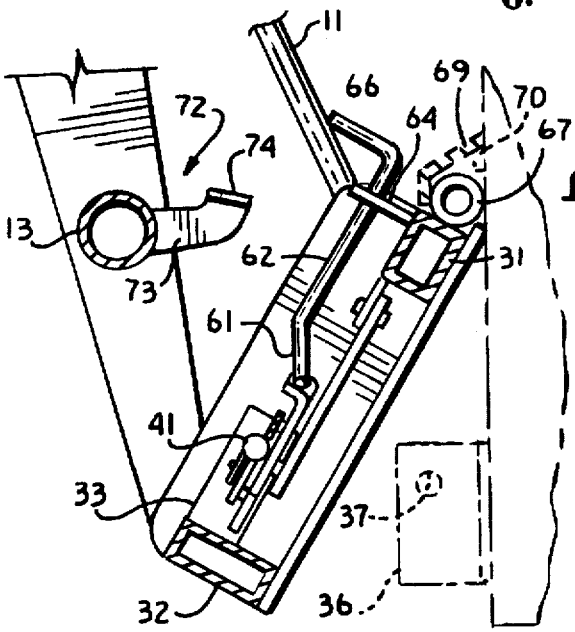
Fig.6.
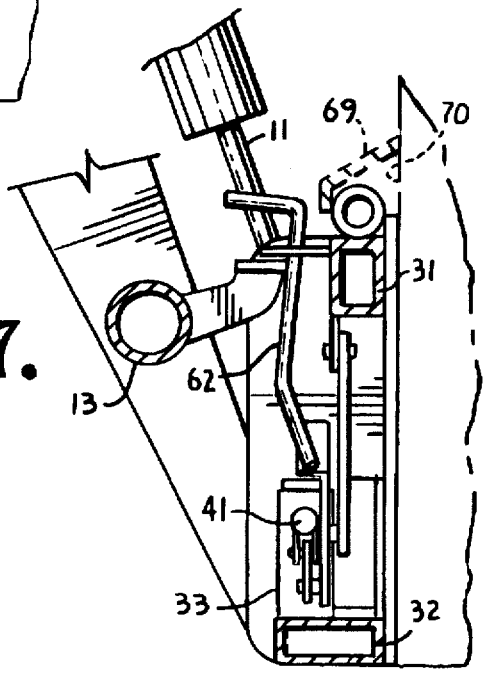
Fig.7.

QUICK ATTACH SYSTEM FOR FRONT END LOADER

FIELD OF THE INVENTION

The present invention relates to an improved quick attach system for attaching a bucket or other implement to a front end loader. More particularly, the improved quick attach system includes an attachment assembly connected to the front end loader including a pair of spring loaded pins and a pair of alignment members. The alignment members mate with respective recesses on the implement to precisely guide the pins into alignment with mating brackets on the implement. Engagement of the spring loaded pins with the mating brackets is automatically accomplished during engagement of the implement with the front end loader.

BACKGROUND OF THE INVENTION

It is well known to provide front end loaders with a variety of detachable implements to improve the versatility of the loader. Typically such implements are attached by a four point engagement including pins on one of the front end loader or the implement and mating receptacles on the other. Engagement of the pins and the receptacles involves a trial and error process accomplished by repeatedly maneuvering the front end loader near the implement. Finally, once the front end loader is precisely positioned relative to the implement, an operator must climb down from the loader and individually engage each pin and receptacle and insert a locking ring or keeper in each engaged pin to secure it in place.

Numerous prior attempts have been made to design a less cumbersome and more convenient attachment system for front end loaders.

U.S. Pat. No. 3,672,521 to Bauer et al., entitled QUICK ATTACHMENT DEVICE, is directed to an adapter which attaches to the front end loader for connecting a bucket thereto. The adapter includes a top flange which fits under an overhanging shelf on the bucket and a pair of hooks which engage a lip portion of a lower shelf on the bucket. The hooks are locked in place via an over-center locking mechanism.

U.S. Pat. No. 3,794,195 to Clevenger et al., entitled QUICK-ATTACHING MECHANISM, is directed to a similar bucket attaching mechanism with a plate mounted on the front end loader engageable with a flange on the bucket. Hooks controlled by an over-center wedging latch lock the bucket onto the plate.

U.S. Pat. No. 4,119,225 to Macht et al., entitled MOUNTING MEANS FOR ATTACHING AN IMPLEMENT TO A VEHICLE, is directed to a quick attaching mechanism connectable to a front end loader which also mates with a flange on the bucket. A single locking pin is manually controlled by a handle to force the pin into engagement with a bore in the bucket base.

U.S. Pat. No. 4,243,356 to Takojima, entitled QUICK COUPLER, is directed to a quick attaching mechanism with a pair of top-mounted hook members and a pair of bottom-mounted ratchet members connected to the bucket. A mating structure is connected to the front end loader with a pair of upper pins engageable with respective ones of the hook members and a pair of lower pins engageable with respective ones of the ratchet members.

U.S. Pat. No. 5,078,569 to Cook, entitled QUICK ATTACHING MECHANISM FOR A FRONT END LOADER, is directed to a quick attaching mechanism connectable to the front end loader. The mechanism has a pair of J-shaped pins which are normally spring urged to a locking position but which can be cocked to a release position by pulling the pins against the action of the spring and rotating them slightly to engage a detent. A pair of receiving plates are attached to the bucket for receiving the pins which pins are automatically pushed out of their respective detents, moving from the release position to the locking position as a portion of the front end loader structure contacts the pins during engagement of the bucket.

Each of these systems has certain drawbacks. In the case of the Bauer and Clevenger patents, the hooks and the over-center latching mechanism are prone to jam, either in the locked or released position, if compromised by dirt and debris. In the case of the Macht patent, the single center positioned pin latch allows too much side to side movement and stress. In the case of the Takojima patent, the ratcheting locks on the bucket are subject to considerable abuse due to their position, and, in both the Takojima and the Cook patents, release of the latching mechanisms requires two separate manual operations on respective ends of the bucket. Furthermore, in each of these systems, precise alignment of the loader and bucket is required, but is problematical at best.

It is clear then, that a need exists for an improved quick attach system for connecting an implement to a front end loader. Such a quick attach system should be easy to use, should provide reliable and secure attachment of the implement to the loader, and should provide a simple, one step release mechanism for releasing the implement. Alignment between the loader and the implement should be easy to accomplish and the quick attach system should allow attachment of the implement to the loader without requiring manual intervention by the loader operator.

SUMMARY OF THE INVENTION

The present invention is directed to an improved quick attach system for removably attaching an implement, such as a bucket, to a front end loader. The inventive system includes a quick attach assembly with two vertically oriented channel members, one on either side of the assembly, which channel members are positioned to engage pivot pins connected to respective ones of a pair of lift arms and tilt cylinders of the front end loader. A pair of alignment members are attached to the channel members and are positioned to mate with respective alignment slots on the bucket. The assembly also includes a pair of spring-urged locking pins which are connected at a first end to a common scissors-type pin retraction assembly with an upwardly extending release handle. The locking pins are normally urged outward to engage respective pin receiving brackets on the bucket, but are selectively, simultaneously retractable via the release handle and the scissors-type pin retraction assembly. The release handle extends through a slot in a handle receiving bracket and the slot includes a detent position near one end for retaining the handle, and the connected pin retraction assembly, in a retracted position. A latch operator is connected to the front end loader and is positioned to engage the release handle in its detent position as the tilt arms of the loader are retracted. The release handle is thus automatically forced out of the detent position, allowing the action of the springs to force the locking pins into engagement with the receiving receptacles on the bucket. The bucket is thus solidly attached to the front end loader by the latched quick attach assembly with a four point attachment including the two locking pins and respective brackets and the two alignment members and respective recesses. Release of the bucket is easily accomplished by simply pulling the release handle back to the detent position, where it remains, thus releasing the locking pins from engagement with the bucket brackets.

OBJECTS AND ADVANTAGES OF THE INVENTION

The principal objects of the present invention are: to provide an improved quick attachment system for releasably attaching an implement to a front end loader; to provide such a system in which alignment between the loader and the implement is easily accomplished; to provide such a system in which the implement is securely attached to the loader via a locking mechanism which requires no manual manipulation by an operator; to provide such a system in which a single release handle simultaneously releases a pair of locking pins to remove the implement from the loader; to provide such a system which is relatively impervious to dirt and debris; and to provide such a system which is economical to manufacture and install and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is a top plan view of the quick attach assembly connected to the front end loader, and showing the release handle in a released, detent position.

FIG. 6 is an enlarged, fragmentary cross sectional view, taken along line 6—6 of FIG. 5, and illustrating the quick attach assembly tilted to engage the alignment members with alignment recesses in the bucket.

FIG. 7 is an enlarged, fragmentary cross sectional view, also taken along line 6—6 of FIG. 5, and illustrating the quick attach assembly tilted to a vertical position with the latch actuator engaging the release handle to thereby locking the bucket onto the quick attach assembly.

DETAILED DESCRIPTION OF THE INVENTION

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
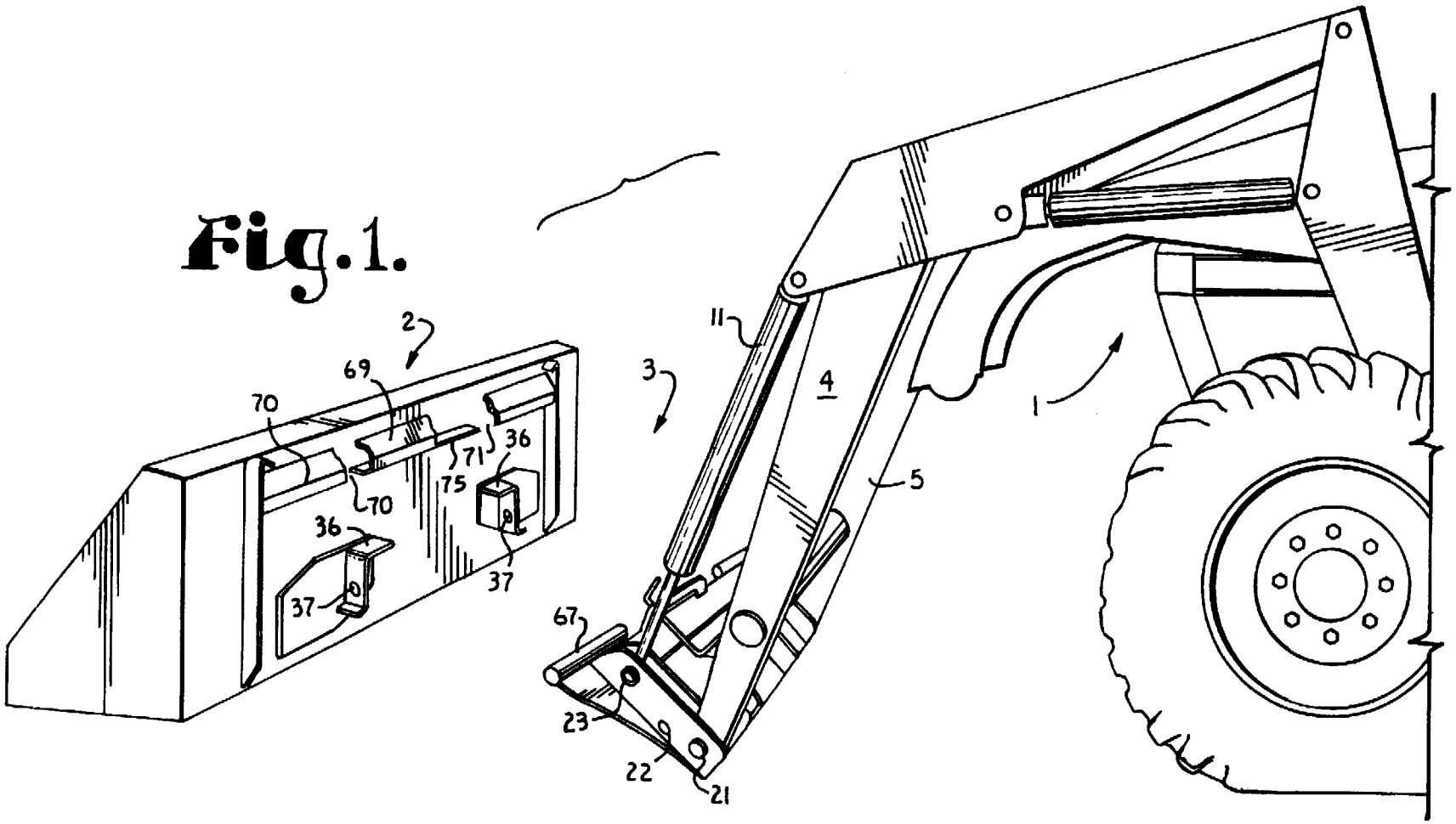
FIG. 1 is a perspective view of a portion of a front end loader and a detached bucket with the loader and bucket being equipped with a quick attachment system in accordance with the present invention.
Figure 2:
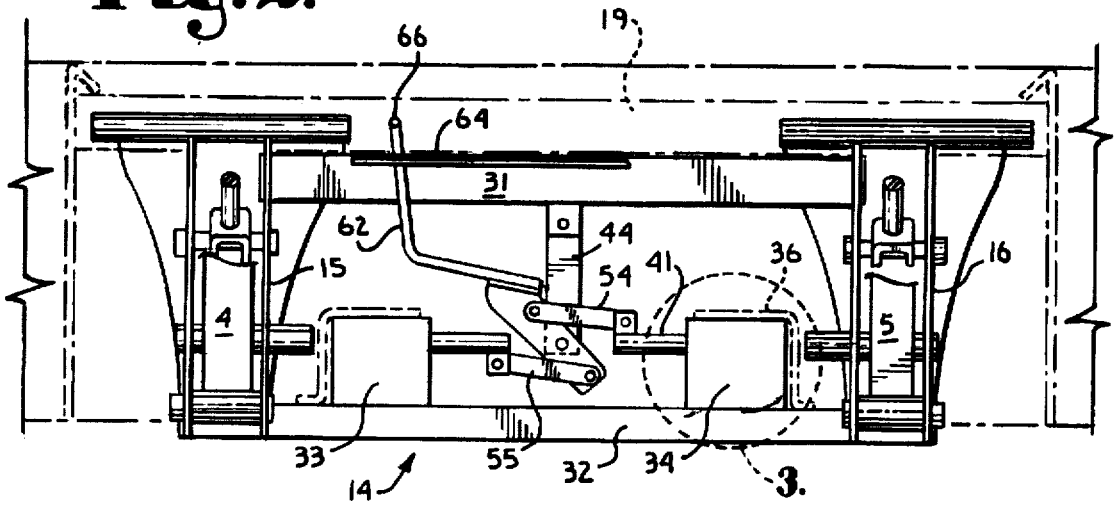
FIG. 2 is a rear elevational view of a quick attach assembly connected to the front end loader with the quick attach assembly being in a release position and with the bucket illustrated in phantom lines.

FIG. 1 illustrates a front end loader 1 and a bucket 2 with an improved quick attach system, generally indicated at 3, for removably attaching the bucket 2 to the front end loader 1. The front end loader 1 includes a conventional lift and tilt structure including a pair of lift arms 4 and 5 and a pair of tilt cylinders 11 and 12. The lift arms 4 and 5 are connected by a reinforcing frame member 13, which, as illustrated, can take the form of a steel cylinder.

The inventive system 3 includes a quick attach assembly 14 with two vertically oriented channel members 15 and 16, one on either side of the assembly 14. Within each channel member 15 and 16 are three reinforced receiving bores 21, 22 and 23, spaced vertically with respect to each other. Each lower bore 21 is positioned to engage a respective pivot clevis 24 connected to a respective end of one of the lift arms 4 and 5. Each upper bore 23 is positioned to engage a pin 25 which pivotably engages a clevis 26 connected to a respective one of the tilt cylinders 11 and 12 or to an alternative tilt linkage (not shown). The tilt cylinders 11 and 12 will hereinafter be called tilt operators 11 and 12 to indicate that alternative tilting mechanisms can be used. The quick attach assembly 14 is thus provided with a four point pivoting attachment to the loader 1 and can be readily tilted and lifted by action of the tilt operators 11 and 12 and the lift arms 4 and 5, respectively.

The channel members 15 and 16 are connected by upper and lower frame members 31 and 32, respectively. A pair of spring housings 33 and 34 are attached to and extend upward from the lower frame member 32. Each spring housing 33 and 34 has a bore 35 extending cross-wise therethrough. A pair of L-shaped locking brackets 36 are attached to and extend rearward from the bucket 2, with each bracket 36 including a through bore 37 sized and positioned to receive a respective one of a pair of locking pins 41. The locking pins 41 extend through respective ones of the through bores 35 and a coil spring 42 within each spring housing 33 and 34 urges a respective one of the locking pins 41 toward an extended position where it engages the remaining, middle bore 22 on a respective one of the channel members 15 and 16. Each pin 41 also engages a respective through bore 37 on one of the brackets 36 when the bucket 2 is in position to be attached, as explained below. A spring collar 43 prevents the coil spring 42 from slipping over the pin 41.

The quick attach assembly 14 also includes a mounting arm 44 attached to and extending downward from the upper frame member 31 to form a part of a scissors-type pin retraction assembly 45. The assembly 45 also includes a pivot plate 46 pivotably attached to the mounting arm 44 at a pivot point 51. The pivot plate 46 includes an upper flat surface 52 to which a lower end of a release handle 53 is attached, by welding or the like. A first pivot arm 54 has one end pivotably connected to the pivot plate 46 above the pivot point 51 and a second pivot arm 55 has one end pivotably connected to the pivot plate 46 below the pivot point 51. Each pivot arm 54 and 55 is pivotably attached at an opposite end to one end of a respective one of the locking pins 41 as it exits the respective spring housing 33 or 34.

The release handle 53 is a rod with a first leg 61 attached to the flat surface 52 of the pivot plate 46. A second leg 62 of the release handle 53 is bent at an angle somewhat less than 90 degrees from the first leg 61 and the second leg 62 extends through a slot 63 in a handle receiving bracket 64. The bracket 64 is attached to and extends forward of the upper frame member 31. The slot 63 includes a detent position 65 near one end for retaining the release handle 53, and the connected pin retraction assembly 45, in a retracted position, held against the action of springs 42. The release handle 53 includes a third leg 66 which extends at an approximately 90 degree angle back toward the front end loader 1 from the second leg 62.

A pair of alignment members 67 and 68 form a part of the quick attach assembly 14. The members 67 and 68, as illustrated, can take the form of lengths of steel cylinders or pipes. Attached to and extending rearward from the bucket 2 is a flange 69 with a pair of alignment recesses 70 and 71 formed thereby. The flange 69 is sealed between the recesses 70 and 71, leaving the recesses 70 and 71 spaced from each other and sized and positioned to receive the alignment members 67 and 68, respectively.

Figure 4:
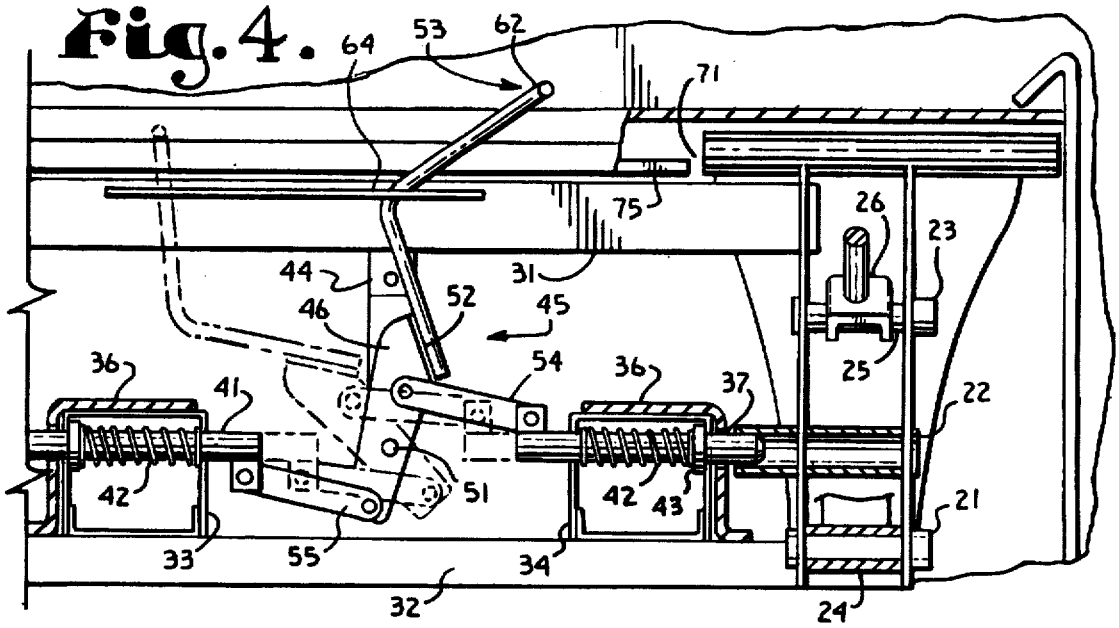
FIG. 4 is an enlarged, fragmentary view of the quick attach system with the quick attach assembly in a locked position in engagement with the bucket.
Figure 3:
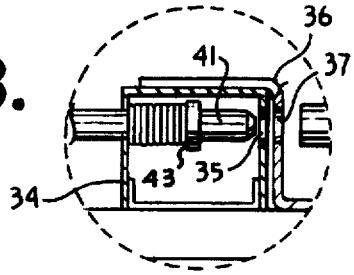
FIG. 3 is a greatly enlarged, fragmentary view of a spring housing of the quick attach assembly, as indicated by the circle labeled "3" in FIG. 2.

As best illustrated in FIGS. 5–7, a latch operator 72 is connected to and extends upward from and forward of the reinforcing frame member 13 of the front end loader 1. The latch operator 72 includes a first, curved flat plate portion 73 which extends tangentially outward from the frame member 13 and a second flat plate portion 74 which extends at an approximately 90 degree angle from the first flat plate 73. In the embodiment illustrated, the second flat plate 74 is positioned to pass just below the handle bracket 64 at the position of the detent 65 as the tilt operators 11 and 12 are retracted. The latch operator 72 thus contacts the second leg 62 of the release handle 53, forcing it from the detent 65 and allowing the springs 42 to force the pin retraction assembly 45 to move to the locked position, as shown in FIGS. 4 and 7. Other variations include extending the latch operator 72 such that it contacts the end of the handle third leg 66 rather than the handle leg 62.

Operation

In order to attach an implement, such as the bucket 2, to the loader 1, an operator first pulls the release handle 53 to the left, allowing it to rest in the detent 65, which causes the pin retraction assembly 45 to retract the pins 41 into the spring housings 33 and 34. The operator then positions the loader lift arms 4 and 5 just above ground level and extends the tilt operators 11 and 12 outward to tilt the quick attach assembly 14 to the approximate angle illustrated in FIG. 1. The loader 1 is then driven forward as it is oriented to bring the alignment members 67 and 68 into engagement with the alignment recesses 70 and 71, respectively. The alignment recesses are positively divided by a flat bar 75 positioned between them. The provision of two alignment members 67 and 68 and two corresponding recesses 70 and 71, divided by the bar 75, allows the operator to precisely position the loader 1 for engagement by providing multiple fields of view for alignment purposes. In other words, if the operator's view of the right alignment member 68 is blocked for any reason, alignment can be accomplished by simply viewing the left member 67 and placing it in the proper alignment recess 70. Although not shown, the alignment recesses 70 and 71 can be brightly colored or otherwise marked for prominent appearance. Once the loader 1 is properly aligned, it is driven forward until the alignment members 67 and 68 are positioned just below the recesses 70 and 71. The lift arms 4 and 5 are then lifted slightly to engage the members 67 and 68 with the recesses 70 and 71, as shown in FIG. 6, thus providing two upper attachment points between the quick attach assembly 14 and the bucket 2.

The tilt arms 11 and 12 are then retracted, bringing the quick attach assembly 14 to an approximately vertical position, as shown in FIG. 7. As the assembly 14 is tilted from the position shown in FIG. 6 to that of FIG. 7, the through bores 37 on the brackets 36 on the bucket 2, are brought into alignment with the pins 42 in the spring housings 33 and 34. Simultaneously, the latch operator 72 contacts the leg 62 of the release handle 53, forcing it out of the detent position 65 and allowing the coil springs 42 to force the pins 42 outward, thus engaging the respective through bores 37 in the brackets 36.

The bucket 2 has a solid four point attachment to the front end loader 1 by the engagement of the pins 42 with the brackets 36 and the engagement of the two alignment members 67 and 68 with the respective alignment recesses 70 and 71.

Release of the bucket 2 is easily accomplished by the operator by simply dropping the bucket 2 to the ground and slightly extending the tilt cylinder 11 and 12. This pulls the latch operator 72 backward and out of the way of the release handle 53. The operator then moves the release handle 53 to the left to the detent position 65. The release handle 53 thus retracts the locking pins 41 back into their respective spring housings 33 and 34 and out of engagement with the brackets 36. The tilt operators 11 and 12 can then be further extended and the lift arms lowered slightly to disengage the alignment members 67 and 68 from their respective recesses 70 and 71, thus freeing the bucket 2 from engagement with the loader 1. The loader 1 can then be backed away and is free to selectively engage another implement.

It is to be understood that while certain forms of the present invention have been illustrated and described herein, it is not to be limited to the specific forms or arrangement of parts described and shown.

What is claimed and desired to be secured by Letters Patent is as follows:

1. A quick attachment system for connecting an implement to a front end loader, said loader including a pair of lift arms and a pair of tilt operators, said system comprising:

a. a quick attach assembly connectable to said lift arms and said tilt operators of said loader, said quick attach assembly including:

i. a pair of locking pins;

ii. a scissors-type pin retracting mechanism connected to both of said pins; and iii. a common release handle connected to said scissors-type pin retracting mechanism, said handle being operative to move said pin retracting mechanism between a locked position and a release position;

iv. a handle receiving bracket, said release handle extending through a slot in said handle receiving bracket, said handle assuming a first position toward a first end of said slot when said pin retracting assembly is in said release position, said handle being positioned in a second position toward a second end of said slot when said pin releasing assembly is in said locked position;

v. a detent formed in said slot toward said first end thereof to maintain said handle in said first position; and vi. a pair of springs attached to respective ones of said locking pins, said springs urging said pin retracting mechanism toward said locked position;

b. a pair of pin receiving brackets attachable to said implement, said pin receiving brackets being positioned such that, when said brackets are attached to the implement, they receive said locking pins when the implement is aligned with a loader equipped with said quick attach assembly and when said pin retracting mechanism is in said locked position; and c. a latching member attachable to said loader, said latching member being alignable with said detent such that, when said handle is in said detent position and when the loader and the implement are aligned, as the loader tilt operators are retracted, the latching member engages the handle, pushing it from said detent position and allowing said springs to move said pin retraction mechanism to said locked position.

2. A quick attachment system as in claim 1, and further comprising:

a. a pair of alignment members forming a part of said quick attach assembly, said alignment members being spaced from each other by a predetermined distance; and b. an alignment flange attachable to a rear surface of said implement, said flange forming a pair of alignment recesses sized to accommodate respective ones of said alignment members, said alignment recesses being spaced apart from each other by the same predetermined distance as said alignment members.

3. A quick attachment system as in claim 1, and further comprising:

a. a pair of spring housings for housing said springs, said locking pins being retracted at least partially within respective ones of said housings when said pin retracting mechanism is in said released position.

4. A quick attachment system for connecting an implement to a front end loader, said loader including a pair of lift arms and a pair of tilt operators, said system comprising:

a. a quick attach assembly connectable to said lift arms and said tilt operators of said loader, said quick attach assembly including:

i. a pair of locking pins;

ii. a scissors-type pin retracting mechanism connected to both of said pins;

iii. a common release handle connected to said scissors-type pin retracting mechanism, said handle being operative to move said pin retracting mechanism between a locked position and a release position;

iv. a pair of springs attached to respective ones of said locking pins, said springs urging said pin retracting mechanism toward said locked position;

v. a pair of alignment members, said alignment members being spaced from each other by a predetermined distance;

vi. a handle receiving bracket, said release handle extending through a slot in said handle receiving bracket, said handle assuming a first position toward a first end of said slot when said pin retracting assembly is in said release position, said handle being positioned in a second position toward a second end of said slot when said pin releasing assembly is in said locked position;

vii. a detent formed in said slot toward said first end thereof to maintain said handle in said first position; and b. a pair of pin receiving brackets attachable to said implement, said pin receiving brackets being positioned such that, when said brackets are attached to the implement, they receive said locking pins when the implement is aligned with a loader equipped with said quick attach assembly and when said pin retracting mechanism is in said locked position;

c. a pair of alignment recesses attachable to said implement, said alignment recesses being sized to accommodate respective ones of said alignment members, said alignment recesses being spaced apart from each other by the same predetermined distance as said alignment members; and d. a latching member attachable to said loader, said latching member being alignable with said detent such that, when said handle is in said detent position and when said alignment members are positioned in the respective alignment recesses, as the loader tilt operators are retracted, the latching member engages the handle, pushing it from said detent position and allowing said springs to move said pin retraction mechanism to said locked position.

5. A quick attachment system as in claim 4, and further comprising:

a. a pair of spring housings for housing said springs, said locking pins being retracted at least partially within respective ones of said housings when said pin retracting mechanism is in said released position.

* * * * *